United States Patent [19]

Kobelt

[11] Patent Number: 4,730,507

[45] Date of Patent: Mar. 15, 1988

[54] INTERCONNECTING CONTROL HEAD FOR TWIN PUSH/PULL CABLES

[76] Inventor: Jacob Kobelt, 6110 Oak Street, Vancouver, British Columbia, Canada, V6M 2W2

[21] Appl. No.: 868,681

[22] Filed: May 30, 1986

[51] Int. Cl.[4] ..... G05G 11/00

[52] U.S. Cl. ..... 74/480 B; 74/480 R; 74/469

[58] Field of Search ..... 74/480 B, 480 R, 875, 74/874; 192/0.096; 440/75, 86; 403/209, 206

[56] References Cited

U.S. PATENT DOCUMENTS

| | | | |
|---|---|---|---|
| 2,314,354 | 3/1943 | Jefferson | 403/209 |
| 2,729,984 | 1/1956 | Morse | 74/875 |
| 2,975,653 | 3/1961 | Morse | 192/0.098 |
| 3,043,159 | 7/1962 | Morse | 74/875 |
| 3,766,801 | 10/1973 | Wiegand | 74/480 B |
| 3,958,524 | 5/1976 | Canthey et al. | 192/0.096 |
| 4,107,825 | 8/1978 | Brawand | 403/209 |
| 4,422,481 | 12/1983 | Palau | 403/41 X |
| 4,470,492 | 9/1984 | Kobelt | 74/480 B |

FOREIGN PATENT DOCUMENTS

| | | | |
|---|---|---|---|
| 1033538 | 7/1958 | Fed. Rep. of Germany | 192/0.096 |
| 1361455 | 4/1964 | France | 74/480 B |

*Primary Examiner*—Andrew V. Kundrat
*Assistant Examiner*—Anthony Knight
*Attorney, Agent, or Firm*—Carver & Co.

[57] ABSTRACT

A control lever apparatus for actuating two sheathed control cables, such as push/pull cables, for connecting together two or more control stations, particularly in marine applications. A manual lever and sprocket are journalled for concurrent rotation relative to a body having a longitudinal body axis. A sheath anchoring structure cooperates with the body and has a sheath clamp adapted for securing the sheaths of the control cables laterally spaced apart and disposed parallel to the body axis. A length of chain passes over the sprocket and has two opposite end portions which extend generally axially of the body. A core connector is secured to each end of the chain and is adapted to be secured to the cores of the control cable assemblies. The apparatus provides a positive and simple mechanical connection between two or more control heads which can be simply installed, and for usual lengths of cable runs does not incur excessive frictional losses.

17 Claims, 8 Drawing Figures

INTERCONNECTING CONTROL HEAD FOR TWIN PUSH/PULL CABLES

BACKGROUND OF THE INVENTION

1. Field of the Invention

The invention relates to a control lever apparatus for actuating two sheathed control cable assemblies which connect together two or more control heads for parallel operation, particularly in marine applications.

2. Prior Art

In marine vessels it is common to provide at least two control heads for controlling the engine, and clutch-/gearbox assemblies of the vessel from two spaced locations, for example on the bridge, and in the engine room. It is essential that the engine and clutch/gearbox assemblies receive only one signal at any one time, and thus the various control heads are coupled together to prevent conflicting signals. In the past there have been various ways of connecting coupled control heads together to overcome this problem. One way is to use a "wire over pulley" system in which taut flexible steel cables passing around pulleys interconnect the two heads together, with means to prevent slippage between the cable and the pulley, for example clamping means. Wire over pulley systems are time consuming to install, and in some vessels require many pulleys to provide straight line runs of cable. Where push/pull cables are used, it is common to connect the pairs of cables from each control head to a common receiving box or integrating apparatus, which integrates the signals and is usually positioned closely adjacent to the apparatus to be controlled, for example adjacent to the engine or clutch/gearbox assembly. Consequently, lengths of push/pull cable from the control heads must pass to the integrating apparatus, and this can involve long lengths of push/pull cable, which is relatively expensive, and, in long runs, can incur considerable friction, which reduces sensitivity of feel for the operator.

SUMMARY OF THE INVENTION

The invention reduces the difficulties and disadvantages of the prior art by providing a relatively simple mechanical system which can be easily installed on a wide range of control heads, with relatively low cost, and there is essentially no limit to the number of control heads which can be coupled together. The present invention uses conventional push/pull cables which extend directly between adjacent control heads which are thus effectively coupled in parallel to the apparatus to be controlled. In contrast with the prior art, it is not necessary to extend respective sets of cables from each control head to the signal integrating apparatus, thus eliminating some relatively long runs of push pull control cable, which in turn reduces friction build up in the system.

A control lever apparatus according to the invention actuates two sheathed control cable assemblies, each sheathed control cable assembly having a core which is axially movable within a respective sheath. The control lever apparatus has a body, a manual lever, a sprocket means, a sheath anchoring means, a length of chain and core connecting means. The body has journalling means and a longitudinal body axis, and the manual lever and sprocket means cooperate with the journalling means for concurrent rotation relative to the body. The sheath anchoring means cooperates with the body and has sheath clamp means adapted for securing the sheaths of the two sheathed control cable assemblies laterally spaced apart. The length of chain passes over the sprocket, and has two opposite end portions which extend generally axially of the body and can be generally aligned with the clamp means. The chain has a length sufficient to accommodate full rotation of the lever while maintaining end portions of the chain generally aligned with the clamp means. The core connecting means are secured to ends of the chain and are adapted to be secured to the cores of the cable control assemblies. Adjusting means are provided for adjusting relative distance between adjacent ends of a core and its respective sheath. The adjusting means is integrated into the assembly to cooperate directly with the respective control cable assembly to be independent of adjacent surroundings and to permit essential elimination of any lost motion that might arise when installed. In one embodiment, the core connecting means includes a generally C-shaped member having means at one end for securing to the ends of the chain, and means at an opposite end for securing to the core of the control cable, so that the core can be axially aligned with an adjacent length of the chain. Preferably, the C-shaped member includes an upper portion having a transverse opening with a transverse axis, the transverse opening being adapted to receive a pin which cooperates directly with a link of the chain. Also, the C-shaped member has a lower portion having a longitudinal opening with a longitudinal axis, the longitudinal opening being adapted to receive the core of the cable which can be secured relative thereto. The longitudinal axis of the lower portion intersects the transverse axis of the upper portion so that adjacent portions of the chain and the core can be axially aligned.

A detailed disclosure following relates to drawings and describes a preferred embodiment of the apparatus which is capable of expression in structure other than that particularly described and illustrated.

DETAILED DISCLOSURE

FIGS. 1 through 4

Figure 1:
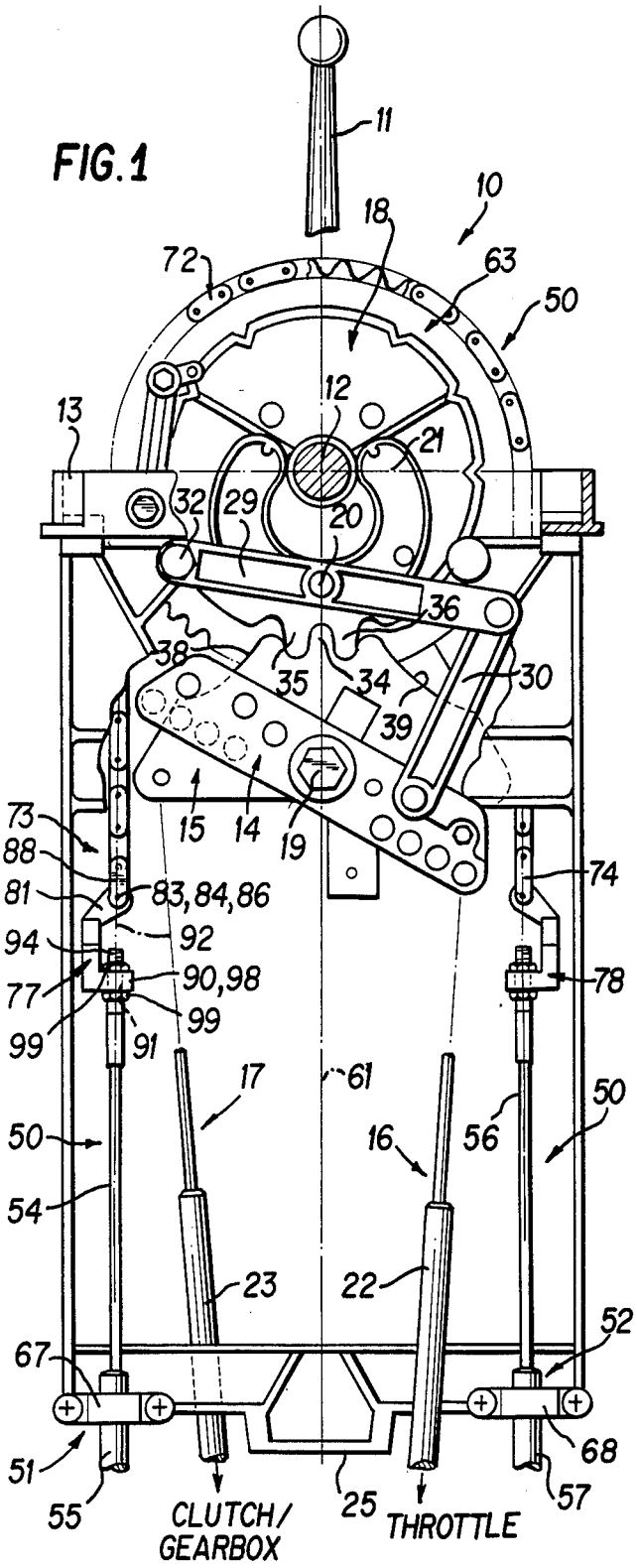
FIG. 1 is a simplified, fragmented front elevation, partially in section of a prior art primary control head fitted with a control lever coupling apparatus according to the invention, the coupling apparatus being adapted to cooperate with a simplified or secondary control head, as seen in FIG. 5.

The present invention is shown incorporated with a single station, single lever control assembly of the present inventor, which resembles a control assembly which is described in greater detail in U.S. Pat. No. 4,470,492, issued Sept. 11, 1984. The invention provides a simple means of coupling together this general type of single lever control assembly, termed a primary control head, to one or more other simpler types, termed secondary control heads, which are used in parallel relationship in remote locations. While the invention is particularly disclosed in FIGS. 1 through 4 for use with this particular type of control assembly, many other types could be substituted and obtain the benefits of the invention.

Briefly, the control lever assembly of the said U.S. Patent is for use in a marine control system where a single lever controls concurrently a clutch and throttle of a marine power unit. The assembly 10 has a manual lever 11 extending from a lever or input shaft 12 which is rotatable relative to a body 13 of the assembly. The assembly has extensible and retractible first and second output structures or means 14 and 15 for controlling a respective function, for example the throttle and clutch-/gearbox respectively. The means 14 and 15 are rocker arms mounted for rotation on a rocker shaft 19 and actuate first and second push/pull sheathed control cables 16 and 17 which extend to the throttle and clutch/gearbox assembly respectively. The assembly 10 includes a cam disc 18 mounted on the input shaft for rotation therewith, and a cam follower 20 cooperating with the cam and the first output structure 15. The cam is a curved walled groove 21 and the cam follower is a roller riding in the groove which is shifted as the cam disc rotates in response to rotation of the shaft 12. A cam follower arm 29 is hinged at an inner end 32 thereof to the body, and carries the cam follower 20 so that rotation of the cam rotates the cam follower arm about the inner end 32. A hinged link 30 extends from the arm 29 to the output means 14. The rotation of the arm 29 is transferred through the link 30 to the means 14, which in turn rotates about the rocker shaft 19 and actuates the push/pull control cable 16 which is connected to the throttle. Sheaths 22 and 23 of the cables 16 and 17 respectively are secured to a lower portion 25 of the body to prevent movement. The cam follower 20 moves an amount dependent on direction and rotation of the input shaft 12 from an initial position thereof and on the geometry of the cam itself. The cam groove 21 has a primary portion which is concentric with the shaft 12, and a pair of similar secondary portions which straddle the primary portion and curve inwardly toward the shaft. As described in the patent, the first output means 14 is unresponsive to primary rotation of the shaft and is responsive to secondary rotation thereof.

The second output structure or means 15 has a central tooth 34 with clearances on each side, the tooth being adapted to engage a clearance between two complementary teeth 35 and 36 extending from the cam disc 18 as shown, when the lever 11 is in a central vertical position as shown. Concave clearance surfaces 38 and 39 extend on either side of the tooth 34 and are complementary to adjacent cylindrical surfaces of the cam disc 18 when the second output structure 15 has rotated to a secondary position. The means 15 is responsive to primary rotation of the shaft 12 from the centered position, and is unresponsive to secondary rotation of the shaft when the means 15 is inclined in the secondary position.

A more detailed explanation of the operation of this basic single station control assembly can be obtained from the patent. The present invention permits this primary twin output control lever to be easily coupled to a more simple secondary control lever for parallel operation in remote locations.

A coupling apparatus 50 according to the invention is for actuating first and second sheathed control cable assemblies 51 and 52 which extend from the primary lever assembly 10 to the secondary, simplified control lever assembly as will be described with reference to FIGS. 5 through 7. The control cable assembly 51 has a first core 54 which is axially movable within a respective first sheath 55. Similarly, the cable assembly 52 has a second core 56 which is axially movable within a second sheath 57. The body 14 has journalling means 59 for the shaft 12, and a longitudinal body axis 61 disposed between and parallel to the control cable assemblies 51 and 52. The shaft 12 carries a sprocket 63 and thus the manual lever and sprocket cooperate with the journalling means 59 of the shaft for concurrent rotation relative to the body. First and second sheath clamp means 67 and 68 cooperate with the portion 25 of the frame and are adapted to secure the respective sheaths 55 and 57 of the cable assemblies 51 and 52 laterally and spaced apart and disposed parallel to the axis of the body 61. The lower portion 25 of the body serves as sheath anchoring means which cooperate with the body and the sheath clamp means, so that the sheaths are restricted against movement relative to the body.

A length of chain 72 passes over the sprocket 63 and has first and second opposite end portions 73 and 74 which extend generally axially of the body and can be generally aligned with the clamp means. The length of chain 72 is a conventional pinned link chain and is sufficiently long to accomodate full rotation of the lever 11, usually through about 90 degrees, and maintain a few links at each end extending tangentially from, and clear of the sprocket. First and second generally C-shaped members 77 and 78 connect the first end portion 73 to the first core 51, and the second end portion 74 to the second core 56 respectively. The C-shaped members serve as core connecting means secured to ends of the chain and adapted to be secured to the cores of the cable control assemblies.

Figure 4:
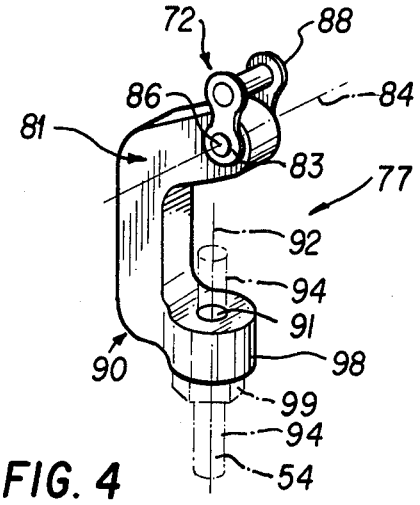
FIG. 4 is a simplified perspective of a core connecting means interconnecting a cable core and chain link.

As best seen in FIG. 4 the C-shaped member 77 has an upper portion 81 having a transverse opening 83 with a transverse axis 84 adapted to receive a pin 86 which cooperates directly with an end link 88 of the chain. The C-shaped member has a lower portion 90 having a shoulder portion 98 provided with a longitudinal opening 91 having a longitudinal axis 92. The longitudinal opening is adapted to receive an outer end 94 of the core 54 of the cable assembly. The core has an outer portion 94 carrying a pair of nuts 99 (one only shown in FIG. 4) which sandwich the shoulder portion therebetween so that the core of the cable is secured relative to the C-shaped member. It can be seen that the longitudinal axis 92 of the lower portion intersects the transverse axis 84 of the upper portion 81 so that the adjacent portions of the chain and the core can be axially aligned.

Figure 7:
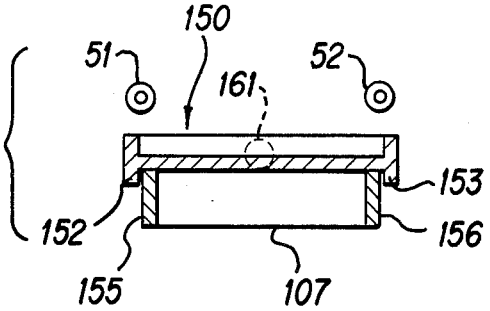
FIG. 7 is a simplified fragmented section on line 7—7 of FIG. 5.
Figure 5:
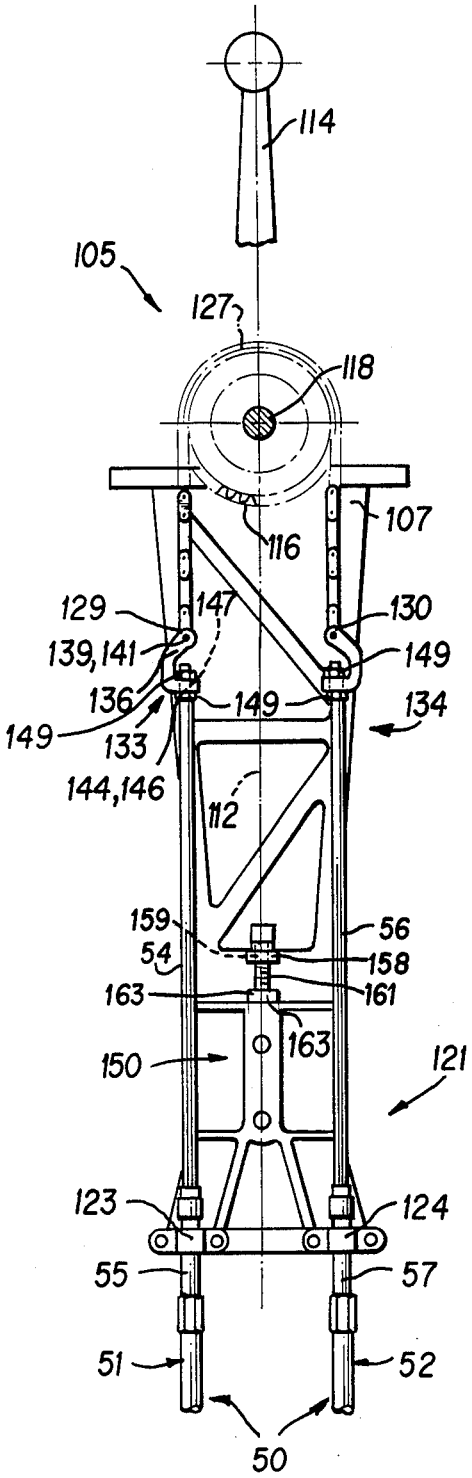
FIG. 5 is a simplified, fragmented front elevation of portions of the simplified or secondary control head, fitted with a control lever apparatus according to the invention, and being adapted to cooperate with the control head of FIG. 1.
Figure 6:
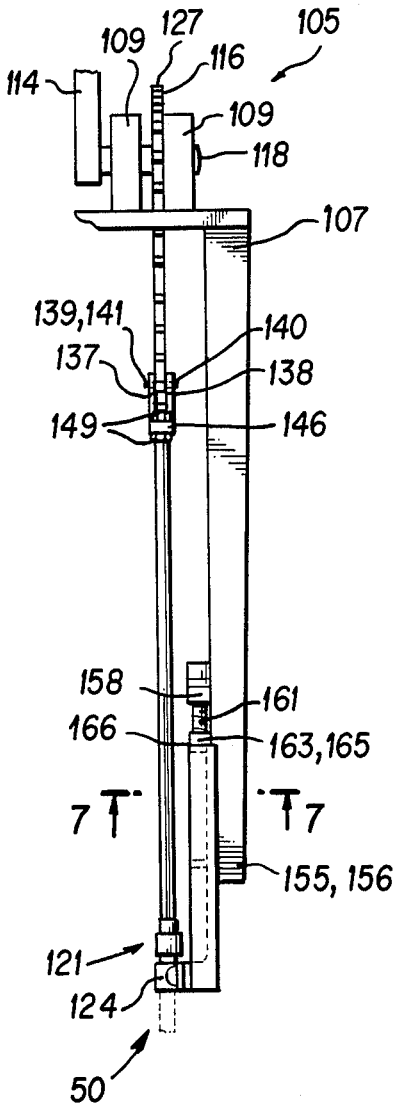
FIG. 6 is a simplified fragmented side elevation of the FIG. 5 apparatus.
Figure 8:
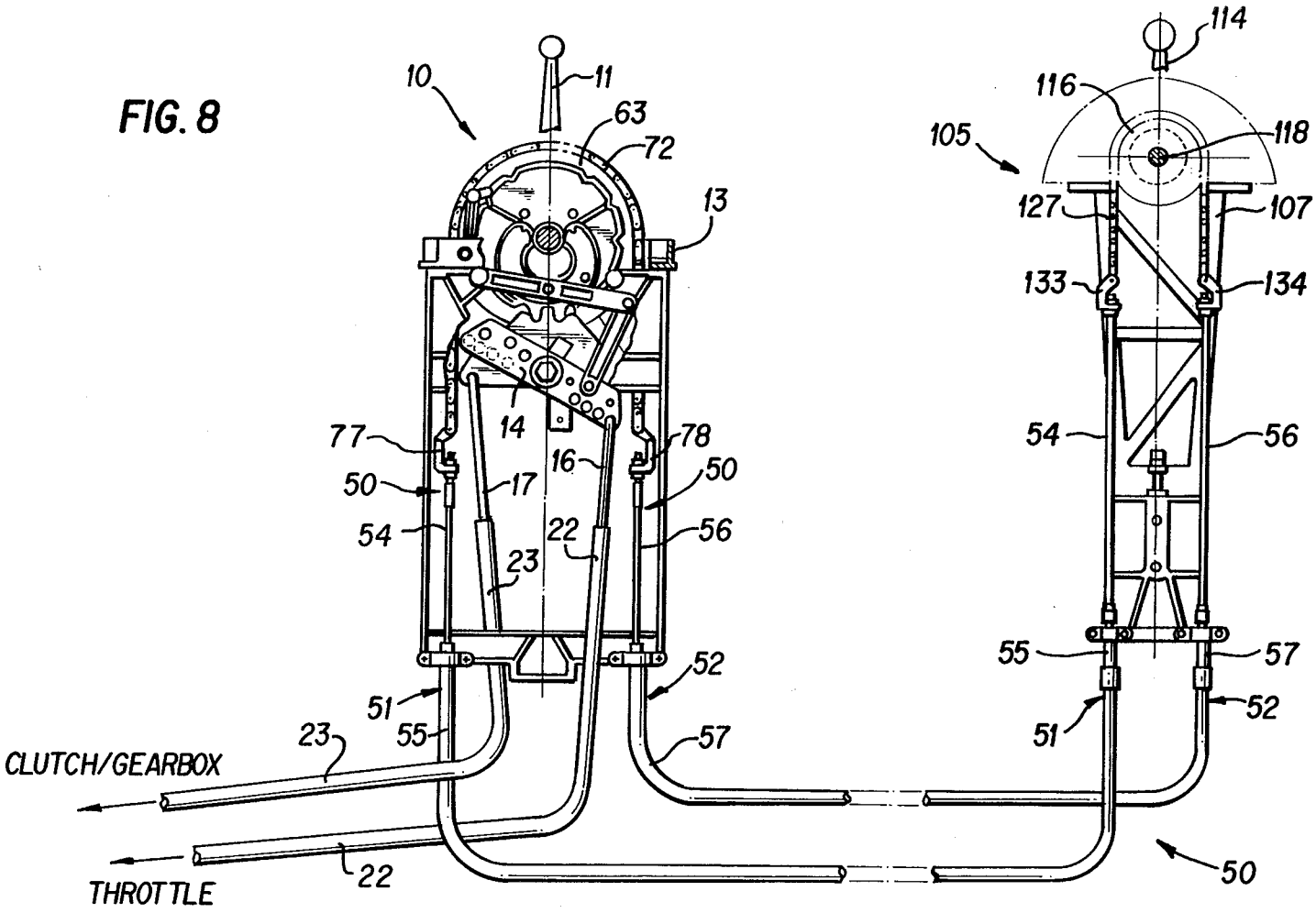
FIG. 8 is a simplified diagram showing cable connections between the control heads of FIGS. 1 and 5 and coupling to clutch/gearbox and throttle controls.

FIGS. 5 through 7

Figure 2:
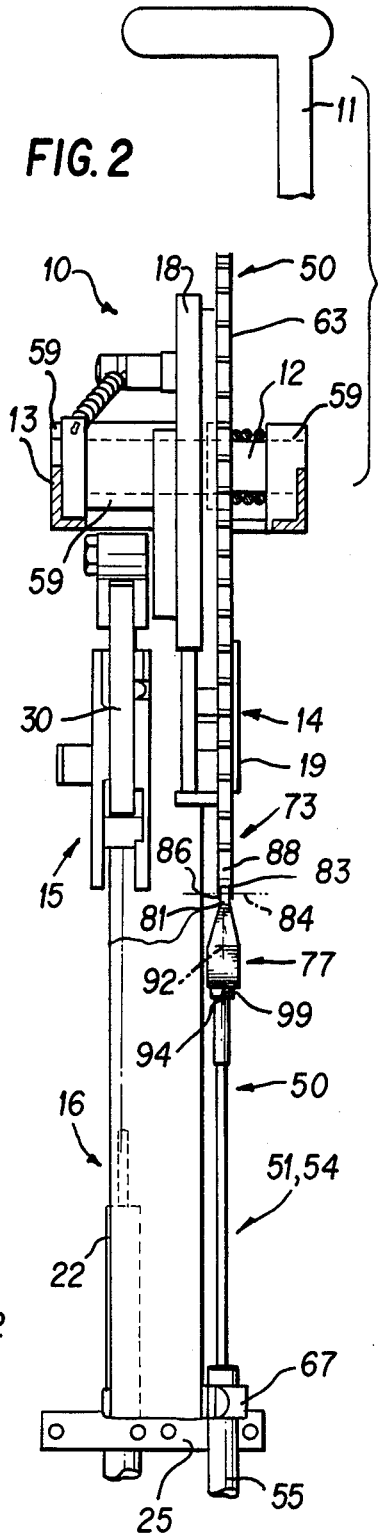
FIG. 2 is a simplified, fragmented end elevation, partially in section showing the control head FIG. 1.
Figure 3:
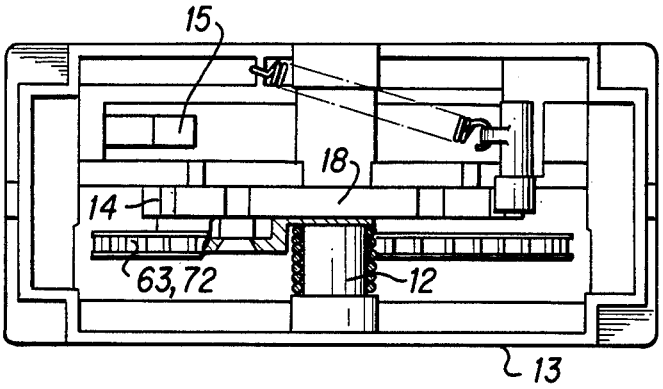
FIG. 3 is a simplified, top plan of the assembly of FIG. 1, shown partially in section.

A secondary control lever assembly 105 according to the invention provides a simpler control head which is directly mechanically coupled through the coupling apparatus 50 to the control lever assembly 10 of FIGS. 1 through 3. The assembly 105 cooperates with opposite ends of the first and second sheathed control cable assemblies 51 and 52. The assembly 105 has a body 107 having journalling means 109, and a longitudinal body axis 112. A manual lever 114 and a sprocket 116 are carried on a lever shaft 118 and thus cooperate with the journalling means for concurrent rotation relative to the body. A sheath anchoring means 121 cooperates with the body 107 and has sheath clamp means 123 and 124 securing the sheaths 55 and 57 of the two cable assemblies 51 and 52 laterally spaced apart and disposed parallel to the axis 112 of the body. A second length of chain 127 passes over the sprocket 116, and has first and second opposite end portions 129 and 130 which extend generally axially of the body and can be generally aligned with the clamp means. Alternative first and second generally C-shaped members 133 and 134 are secured to ends of the chain and adapted to be connected to the cores 54 and 56 respectively.

The C-shaped member 133 has an upper portion 136 having pair of spacedapart arms 137 and 138 having transversely aligned transverse openings 139 and 140 therein adapted to receive a pin 141 which cooperates directly with an end link of the chain. Similarly to the C-shaped members of FIGS. 1 through 4, the C-shaped member 133 has a lower portion 144 having a shoulder portion 146 having a longitudinal opening 147 to receive the core 54 of the cable assembly 52. It can be seen that both types of C-shaped members have means at one end for securing to the end of the chain, and means at an opposite end for securing to the core of the control cable, so that the cable core can be axially aligned with an adjacent length of the chain.

As previously described, the outer end of the core is threaded and secured to the adjacent shoulder portion 146 using a pair of spaced nuts 149, and this provides a degree of adjustment for providing sufficient tension in the chain so as to essentially eliminate lost motion in the linkage between the two control lever assemblies. In some instances, it may be desirable to provide an additional amount of adjustment, particularly for long runs of push pull cable which may exhibit amounts of lost motion which cannot be easily accommodated with the threaded end of the cores of the cable. An alternative means of accomodating lost motion is provided, particularly for application with the more simple control assembly as shown in FIGS. 5 through 7, although the alternative could be used with the primary control lever assembly 10.

Means to provide additional adjustment of the control cables includes a sheath anchoring means 150 which cooperates with the frame for axial movement relative to the frame. As seen in FIG. 7, the sheath anchoring means has a pair of laterally spaced parallel guide flanges 152 and 153 which are complementary to and embrace parallel sides 155 and 156 of the body 107. It can be seen that the sheath anchoring means functions as a simple carriage sliding on the frame and guided by flanges engaging the sides. The clearance between the guide flanges and sides is such that the sheath anchoring means can slide freely, with very limited lateral or rotational movement relative to the body. The sides 155 and 156 serve as body guide means disposed axially of the body. The flanges 152 and 153 serve as sheath guide means generally complementary to the body guide means so that the sheath anchoring means is guided axially relative to the body.

The body has a centrally located boss 158 with an axially disposed threaded opening 159 and a complementary screw 161 extends axially through the opening 159. The sheath anchoring means 150 has an anchoring boss 163 having a clearance opening 165 which receives an outer end of the screw 161. The outer end of the screw carries a stop means 166 which straddles the anchoring boss to prevent lateral movement relative thereto, yet permit rotation of the screw within the clearance opening. Clearly, rotation of the screw moves the sheath anchoring means as a carriage axially relative to the frame, thus providing adjusting means cooperating with the sheath anchoring means and the body for causing axial movement of the sheath anchoring means. Locking nuts can be provided on the screw to lock the sheath anchoring means relative to the body at a desired location. Clearly, location of the boss 158 and the anchoring boss 163 can be interchanged to produce an equivalent structure. In effect, the adjusting means includes an axially disposed screw extending between the body and the sheath anchoring means, with a threaded sleeve cooperating with the screw so that relative rotation between the screw and the threaded sleeve moves the sheath anchoring means axially. For most applications, travel of the sheath anchoring means of about 3 or 4 cms is adequate to accommodate most lost motion that might be generated within a long run of push/pull cable. It can be seen that the main difference between the sheath anchoring means of the first and second embodiments relates to the provision of additional adjustment to compensate for lost motion in the push/pull control cable system. It can be seen that the outer portion 94 and the nuts 99, (FIGS. 1 and 4) cooperating with the C-shaped member 77, (FIGS. 1 and 4) and the axially moveable sheath anchoring means 150 (FIGS. 5 and 6) both serve as adjusting means to adjust relative distance between ends of a core and its respective sheath. These adjusting means are integrated into the control lever assembly to cooperate directly with the control cable assembly and are independent of adjacent structure. In other words, additional anchor brackets are not required to be secured to adjacent structure of the vessel to locate ends of the sheaths of the cable, to secure pulleys etc. that otherwise might be required to eliminate lost motion. Clearly, when the adjusting means are integrated directly into the assembly, installation of the complete assembly into the vessel is much simpler, and essential elimination of any lost motion is also usually simpler. This contrasts with the conventional "wire-over-pulley" systems previously referred to wherein installation is time-consuming and adjustment for lost motion can be difficult. Clearly a second sprocket (not shown) can be fitted to either assembly for coupling with additional sheathed control cables to a second simplified control lever assembly at a third station, not shown, on the vessel.

OPERATION

In a normal dual control set up, a control cabin of the vessel would normally be provided with the control lever assembly 10 which provides simultaneous throttle and clutch/gearbox control with a single lever. The push/pull sheathed cable assemblies 16 and 17 extend to the throttle and clutch/gearbox respectively from the first and second output structure 14 and 15 as is well known in the trade. The first and second sheathed control cables 51 and 52 extend from the body 13 of the assembly 10 to the body 107 of the second embodiment of the invention 105 and cooperate with respective lengths of chain. Because the chains cannot slip on the sprockets it can be seen that rotation of the sprocket 116 for the second embodiment 105 causes parallel and equal rotation of the sprocket 63 of the embodiment 10, which movement is reflected by actuation of the first and second output structures 14 and 15. Clearly, with similar diameter sprockets, both levers move equal amounts in the same direction, and conflicting signals cannot be applied at the two control heads. Duplication of the complex signal integration means of the first lever control assembly is not required at the second single lever control assembly and installation and servicing problems are reduced.

From the above, it can be seen that the invention provides a simple means of coupling two or more control heads together, while preventing conflicting signals and eliminating some of the complexity of prior art control head coupling means.

In summary, it can be seen that the invention provides a coupling apparatus for coupling together first and second control lever assemblies having first and second manual levers and bodies, each manual lever being rotatable relative to the respective body. The apparatus includes first and second sprockets, first and second lengths of chain and first and second sheathed control cable assemblies. The first and second sprockets are mounted for rotation concurrently with the respective first and second manual levers. The first and second lengths of chain pass over the first and second sprockets respectively, each length of chain having end portions which are spaced from the sprocket. The first and second sheathed control cable assemblies interconnect the first and second lengths of chain to form a continuous loop extending between the two sprockets, so as to couple together the two control levers for concurrent rotation. Clearly, four generally C-shaped connecting means are required for the loop and chains and push-/pull control cables.

The invention also provides a simple connecting means for connecting a chain to a push/pull control cable assembly, in which the chain has a plurality of links and pins, and the push/pull control cable assembly has a core which is axially movable within a sheath. The connecting means is generally C-shaped and has means at one end for securing to an end of the chain, and means at an opposite end for securing to the core of the control cable, so that the core can be axially aligned with an adjacent length of the chain.

I claim:

1. A control lever apparatus for actuating two sheathed control cable assemblies, the control lever apparatus having:

(a) a body having journalling means and a longitudinal body axis, (b) a manual lever and sprocket means cooperating with the journalling means for concurrent rotation relative to the body, (c) a sheath anchoring means cooperating with the body and having sheath clamp means adapted for securing end portions of sheaths of the two sheathed control cable assemblies relative to the body and laterally spaced apart, (d) a length of chain passing over the sprockets, the chain having two opposite end portions which can extend generally axially of the body and can be generally aligned with the clamp means, the chain having a length to accommodate full rotation of the lever while maintaining end portions of the chain generally aligned with the sheath clamp means, (e) core connecting means secured to ends of the chain and adapted to be secured to respective cores of the sheathed control cable assemblies, each core being axially moveable within a respective sheath, (f) adjusting means for adjusting relative distance between adjacent ends of a core and its respective sheath, the adjusting means being integrated into the control lever assembly to cooperate directly with the control cable assembly and to be independent of adjacent surrounding structure, so as to facilitate installation and essential elimination of any resulting lost motion.

2. An apparatus as claimed in claim 1 in which:

(a) the core connecting means includes a generally C-shaped member having means at one end for securing to an end of the chain, and means at an opposite end for securing to a core of the control cable, so that the core can be axially aligned with an adjacent length of the chain.

3. An apparatus as claimed in claim 2 in which the generally C-shaped member includes:

(a) an upper portion having a transverse opening with a transverse axis, the transverse opening being adapted to receive a pin which cooperates directly with an end link of the chain, (b) a lower portion having a longitudinal opening with a longitudinal axis, the longitudinal opening being adapted to receive the core of the cable which can be secured relative thereto, and the longitudinal axis of the lower portion intersects the transverse axis of the upper portion, so that adjacent portions of the chain and core can be axially aligned.

4. An apparatus as claimed in claim 3 in which:

(a) the upper portion of the C-shaped member has a pair of spaced apart arms having transversely aligned transverse openings therein adapted to receive the pin which cooperates directly with the link of the chain, the arms being spaced apart sufficiently to receive the link therebetween and the lower portion has a shoulder portion having the longitudinal opening to receive the core of the sheathed control cable assembly, (b) the core has a threaded outer portion carrying a pair of nuts which sandwich the shoulder portion therebetween to secure the core to the C-shaped member, and to permit longitudinal adjustment therebetween.

5. An apparatus as claimed in claim 1, further characterized by:

(a) the sheath clamp means being adapted to secure end portions of the sheaths of the control cable assemblies parallel to the axis of the body, (b) the sheath anchoring means cooperating with the body for axial movement relative to the body, (c) the adjusting means cooperating with the sheath anchoring means and the body for causing the said axial movement of the sheath anchoring means, and to permit the sheath anchoring means to be locked relative to the body.

6. An apparatus as claimed in claim 5 in which:

(a) the adjusting means includes an axially disposed screw extending between the body and the sheath anchoring means, and a threaded sleeve cooperating with the screw so that relative rotation between the screw and the threaded sleeve moves the sheath anchoring means axially.

7. An apparatus as claimed in claim 5 in which:

(a) the body has body guide means disposed axially of the body, (b) the sheath anchoring means has sheath guide means generally complementary to the body guide means so that the sheath anchoring means is guided axially relative to the body.

8. An apparatus as claimed in claim 1 further including:

(a) output means for providing an output signal to reflect position of the manual lever, the output means being adapted to be coupled to at least one control signal transmitter in addition to the said two sheathed control cable assemblies.

9. A control lever apparatus for actuating two sheathed control cable assemblies, the control lever apparatus having:

(a) a body having journalling means and a longitudinal body axis, (b) a manual lever and sprocket means cooperating with the journalling means for concurrent rotation relative to the body, (c) a sheath anchoring means cooperating with the body and having sheath clamp means adapted for securing end portions of sheaths of the two sheathed control cable assemblies relative to the body and laterally spaced apart, (d) a length of chain passing over the sprockets, the chain having two opposite end portions which can extend generally axially of the body and can be generally aligned with the clamp means, the chain having a length to accommodate full rotation of the lever while maintaining end portions of the chain generally aligned with the sheath clamp means, (e) core connecting means secured to ends of the chain and adapted to be secured to respective cores of the sheathed control cable assemblies, each core being axially moveable within a respective sheath, the core connecting means including a generally C-shaped member having an upper portion having a transverse opening with a transverse axis, the transverse opening being adapted to receive a pin which cooperates directly with an end link of the chain for securing the C-shaped member to an end of the chain, the C-shaped member also having a lower portion having a longitudinal opening with a longitudinal axis, the longitudinal opening being adapted to receive the core of the cable which can be secured relative thereto, the longitudinal axis of the lower portion also intersecting the transverse axis of the upper portion so that the core can be axially aligned with an adjacent length of the chain.

10. An apparatus as claimed in claim 9 in which:

(a) the upper portion of the C-shaped member has a pair of spaced apart arms having transversely aligned transverse openings therein adapted to receive the pin which cooperates directly the link of the chain, the arms being spaced apart sufficiently to receive the link therebetween, and the lower portion of the C-shaped member has a shoulder portion having the longitudinal opening to receive the core of the sheathed control cable assembly.

11. A control lever apparatus for actuating two sheathed control cable assemblies, the control lever apparatus having:

(a) a body having journalling means and a longitudinal body axis, (b) a manual lever and sprocket means cooperating with the journalling means for concurrent rotation relative to the body, (c) a sheath anchoring means cooperating with the body and having sheath clamp means adapted for securing end portions of sheaths of the two sheathed control cable assemblies relative to the body and laterally spaced apart, so as to be parallel to the axis of the body and laterally spaced apart, the sheath anchoring means cooperating with the body for axial movement relative to the body, (d) adjusting means cooperating with the sheath anchoring means and the body for causing the said axial movement of the sheath anchoring means, and to permit the sheath anchoring means to be locked relative to the body, (e) a length of chain passing over the sprockets, the chain having two opposite end portions which can extend generally axially of the body and can be generally aligned with the clamp means, the chain having a length to accommodate full rotation of the lever while maintaining end portions of the chain generally aligned with the sheath clamp means, (f) core connecting means secured to ends of the chain and adapted to be secured to respective cores of the sheathed control cable assemblies, each core being axially moveable within a respective sheath.

12. An apparatus as claimed in claim 11 in which:

(a) the adjusting means includes an axially disposed screw extending between the body and the sheath anchoring means, and a threaded sleeve cooperating with the screw so that relative rotation between the screw and the threaded sleeve moves the sheath anchoring means axially relative to the body.

13. An apparatus as claimed in claim 11 in which:

(a) the body has body guide means disposed axially of the body, (b) the sheath anchoring means has sheath guide means generally complementary to the body guide means so that the sheath anchoring means is guided axially relative to the body.

14. A coupling and control apparatus including:

(a) first and second control lever assemblies having first and second manual levers and bodies respectively, each lever being rotatable relative to the respective body, the lever assemblies also having respective first and second sprockets mounted for rotation concurrently with the respective first and second levers, each lever reflecting relative position of the respective sprocket, (b) first and second lengths of chain passing over the first and second sprockets, each length of chain having respective end portions and a length sufficient to accommodate rotation of the sprocket, (c) first and second sheathed control cable assemblies for interconnecting the first and second lengths of chain, each sheathed control cable assembly having a core and a sheath, the core of each control cable assembly has one end secured to an end link of the first length of chain and an opposite end secured to an end link of the second length of chain to form a continuous loop extending between the two sprockets, each core being axially moveable within a respective sheath to transmit concurrently rotation of one lever to the other lever, the sheath of each control cable assembly having one end secured to the body of the first lever assembly, and an opposite end secured to the body of the second lever assembly, (d) four generally C-shaped members are provided to connect the ends of the chains to the cores of the control cable assemblies to that end portions of the chains can extend generally axially of the body and can be aligned with and connected to the respective cores, each generally C-shaped member including an upper portion having a transverse opening with a transverse axis, the transverse opening being adapted to receive a pin which cooperates directly with the end link of the chain, each C-shaped member also including a lower portion having a longitudinal opening with a longitudinal axis, the longitudinal opening being adapted to receive the core of the cable which can be secured relative thereto, the longitudinal axis of the lower portion intersecting the transverse axis of the upper portion, so that adjacent portions of the chain and core can be axially aligned.

15. A coupling and control apparatus including:

(a) first and second control lever assemblies having first and second manual levers and bodies respectively, each lever being rotatable relative to the respective body, the lever assemblies also having respective first and second sprockets mounted for rotation concurrently with the first and second levers, each lever reflecting relative position of the respective sprocket, (b) first and second lengths of chain passing over the first and second sprockets, each length of chain having respective end portions and a length sufficient to accommodate rotation of the sprocket, (c) first and second sheathed control cable assemblies, each sheathed control cable assembly having a core and a sheath, each core having opposite ends, the end of each core being connected to a respective end of a length of chain to form a continuous loop of two chains and two cores extending between the two sprockets, the sheaths of the cable assembly having opposite ends secured relative to the bodies of the control lever assemblies, the cores being axially slidable within a respective sheath so that rotation of one sprocket is transmitted concurrently to the other sprocket, (d) at least one control lever assembly having an adjusting means for adjusting relative distance between adjacent ends of a core and its respective sheath, the adjusting means being integrated into the control lever assembly to cooperate directly with the control cable assembly and to be independent of adjacent surrounding structure, so as to facilitate installation and essential elimination of any resulting loss of motion.

16. A coupling apparatus as claimed in claim 15, in which:

(a) the sheath of each control cable assembly has one end secured to the body of the first lever assembly, and an opposite end secured to the body of the second lever assembly, (b) the core of each control cable assembly has one end secured to an end link of the first length of chain, and an opposite end secured to an end link of the second length of chain, (c) four generally C-shaped members are provided to connect the chains to the cores of the cables, so that end portions of the chains can extend generally axially of the body and be alligned with and connected to the respective core of the cable.

17. A coupling apparatus as claimed in claim 16 in which each generally C-shaped member includes:

(a) an upper portion having a transverse opening with a transverse axis, the transverse opening being adapted to receive a pin which cooperates directly with the end link of the chain, (b) a lower portion having a longitudinal opening with a longitudinal axis, the longitudinal opening being adapted to receive the core of the cable which can be secured relative therto, and the longitudinal axis of the lower portion intersects the transverse axis of the upper portion, so that adjacent portions of the chain and core can be axially aligned.

* * * * *